US010619234B2

(12) United States Patent
Boehlert et al.

(10) Patent No.: US 10,619,234 B2
(45) Date of Patent: Apr. 14, 2020

(54) TITANIUM ALLOY AND METHOD OF FORMING A TITANIUM ALLOY

(71) Applicant: Board of Trustees of Michigan State University, East Lansing, MI (US)

(72) Inventors: Carl Boehlert, East Lansing, MI (US); Vahid Khademi, East Lansing, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 469 days.

(21) Appl. No.: 15/408,929

(22) Filed: Jan. 18, 2017

(65) Prior Publication Data

US 2017/0204504 A1 Jul. 20, 2017

Related U.S. Application Data

(60) Provisional application No. 62/279,944, filed on Jan. 18, 2016.

(51) Int. Cl.
*C22C 14/00* (2006.01)
*C22F 1/18* (2006.01)

(52) U.S. Cl.
CPC ..... *C22F 1/183* (2013.01); *C22C 14/00* (2013.01)

(58) Field of Classification Search
CPC ..... C22F 1/183; C22C 14/00
USPC ..... 402/421; 420/421
See application file for complete search history.

(56) References Cited

U.S. PATENT DOCUMENTS

2017/0204504 A1 7/2017 Boehlert et al.

OTHER PUBLICATIONS

Ogawa et al. "Phase Constitution and Isothermal Aging Behavior of Ti—Cr Alloys" 2008 vol. 79 Issue 3 pp. 207-216 https://doi.org/10.4262/denkiseiko.79.207 (Year: 2008).*
Machine translation of Ogawa et al. (Year: 2008).*
Liu, H., et al., "Athermal and deformation-induced ω-phase transformations in biomedical beta-type allow Ti—9Cr-0.20," Acta Materialia, vol. 106, pp. 162-170 (Jan. 21, 2016).
Jones, N. G., et al., "β Phase decomposition in Ti—5A1—5Mo—5V—3Cr," Acta Materialia, vol. 57, pp. 3830-3839 (May 22, 2009).
Prima, F., "Control of omega phase volume fraction precipitation in a beta titanium alloy: Development of an experimental method," Journal of Materials Science Letters 19, pp. 2219-2221 (2000).
Ogawa, et al., "Effect of Cooling Rate on Mechanical Properties of Ti—13Cr—1Fe—3A1 Alloy," Journal of the Japan Institute of Metals, vol. 72, No. 12, Special Issue on Strategy for Ubiquitous Titanium Alloys, pp. 983-988 (2008).
Liu,, H., et al., "Mechanical properties and cytocompatability of oxygen-modified β-type Ti—Cr alloys for spinal fixation devices," Acta Biomaterialia, vol. 12, pp. 352-361 (Oct. 23, 2014).

(Continued)

*Primary Examiner* — Haytham Soliman
(74) *Attorney, Agent, or Firm* — Harness, Dickey & Pierce, PLC

(57) ABSTRACT

An alloy and method for producing an alloy is presented. The Titanium alloy has Ti-xCr-yFe-zAl, where 16>x>10, 4>y>0, and 6>z>0, where the alloy is subjected to strain at a temperature between 250 and 500 degrees C. A portion of the Titanium alloy is converted from a first phase to a second phase.

19 Claims, 13 Drawing Sheets

Electron backscatter diffraction (EBSD) orientation map of the

(56) References Cited

OTHER PUBLICATIONS

"Titanium+alloy—Expand Your Mind." Titanium+alloy—Expand Your Mind. N.p., n.d. Web. Jul. 13, 2015. http://www.revolvy.com/main/index.php?s=Titanium+alloy (8 pages).
France-Metallurgie » Blog Archive » Global High Performance Alloys Market to Reach $9 Billion by 2020 (US). FranceMetallurgie RSS. N.p., n.d. Web. Jul. 13, 2015. http://www.france-metallurgie.com/index.php/2014/08/30/global-high-performance-alloys-market-is-expected-to-reach-9-billion-by-2020-us/#sthash.KDT2iQ87.dpbs (10 pages).
Titanium Alloys—Physical Properties. Titanium Alloys—Physical Properties. Web. Jul. 13, 2015. http://www.azom.com/article.aspx?ArticleID=1341 (15 pages).
Titanium Alloys and Their Characteristics: Part One. :: Total Materia Article. Web. Jul. 13, 2015. http://www.totalmateria.com/page.aspx?ID=CheckArticle&site=ktn&NM=218 (5 pages).
IBIS report: Global Military Aircraft & Aerospace Manufacturing—C2544-GL (35 pages).
IBIS report: Global Commercial Aircraft Manufacturing—C2543-GL (39 pages).
IBIS report: Nonferrous Metal Rolling & Alloying in the US 33149 (39 pages).
Ikeda M et al Materials Transactions (2009) 50:12, 2737 (7 pages).
Chen, W. et al., "Texture induced anisotropy in extruded Ti—6A1—4V-xB alloys." Materials Characterization, vol. 62, pp. 333-339 (2011).
Zhang, Y. et al., "Microstructures and properties of high-entropy alloys." Progress in Materials Science, vol. 61, pp. 1-93 (2014).

* cited by examiner

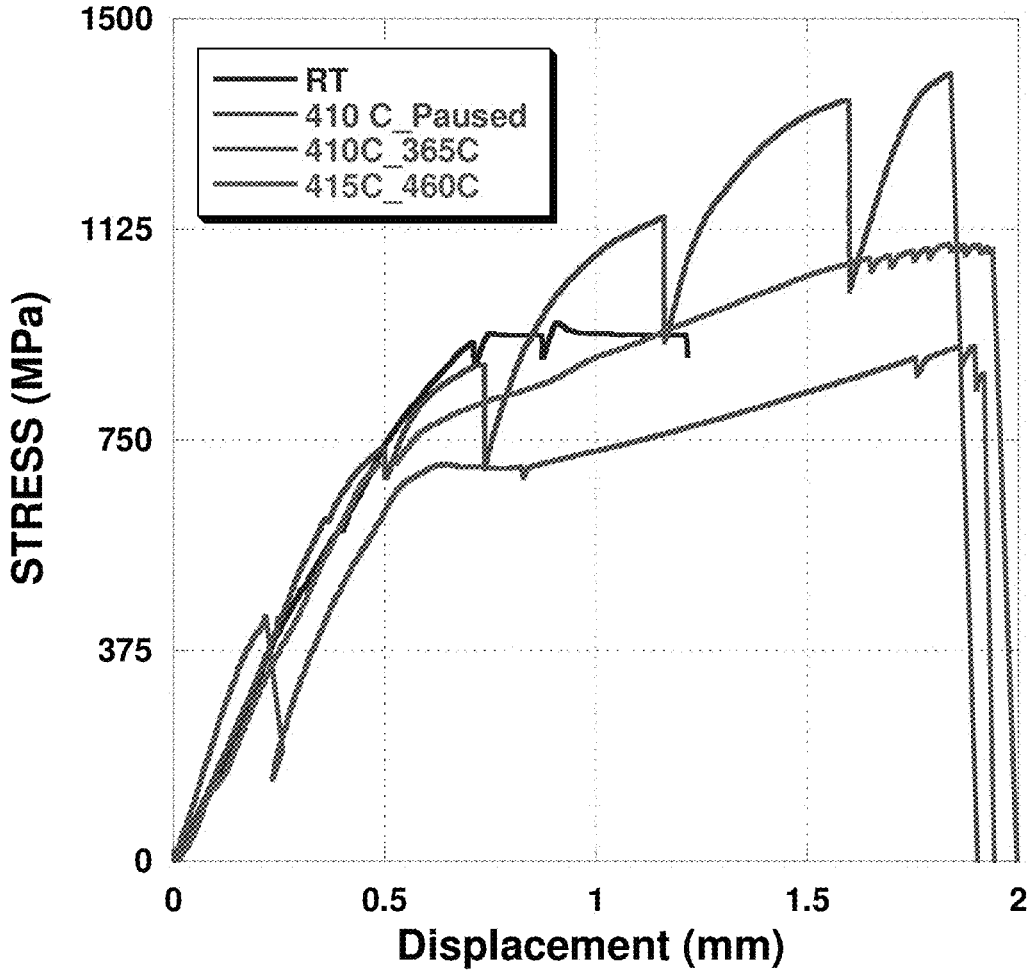
Figure 1. Stress versus displacement curves for the tensile tested sheet material at different temperatures.

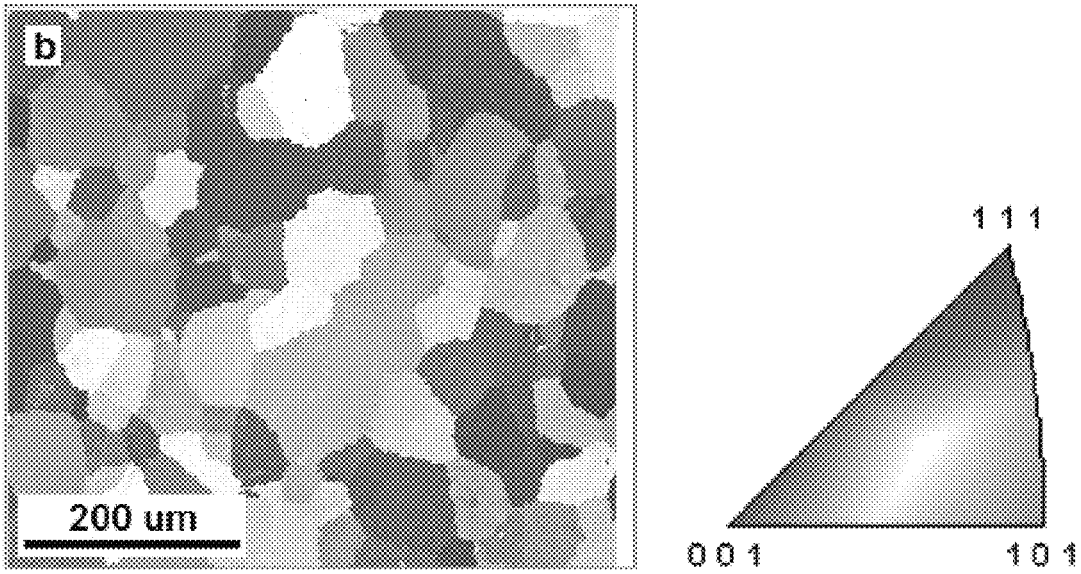
Figure 2. Electron backscatter diffraction (EBSD) orientation map of the
Figure 3a
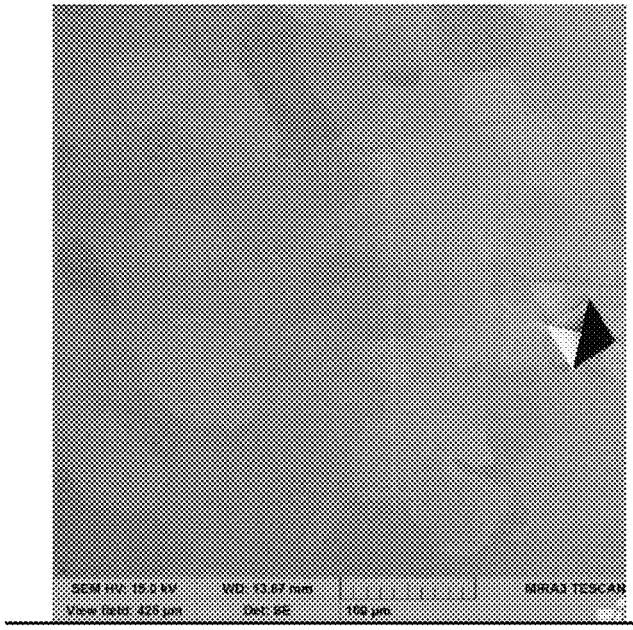

SEM photomicrographs (a) and (b) showing the representative microstructure of the as-received sheet.

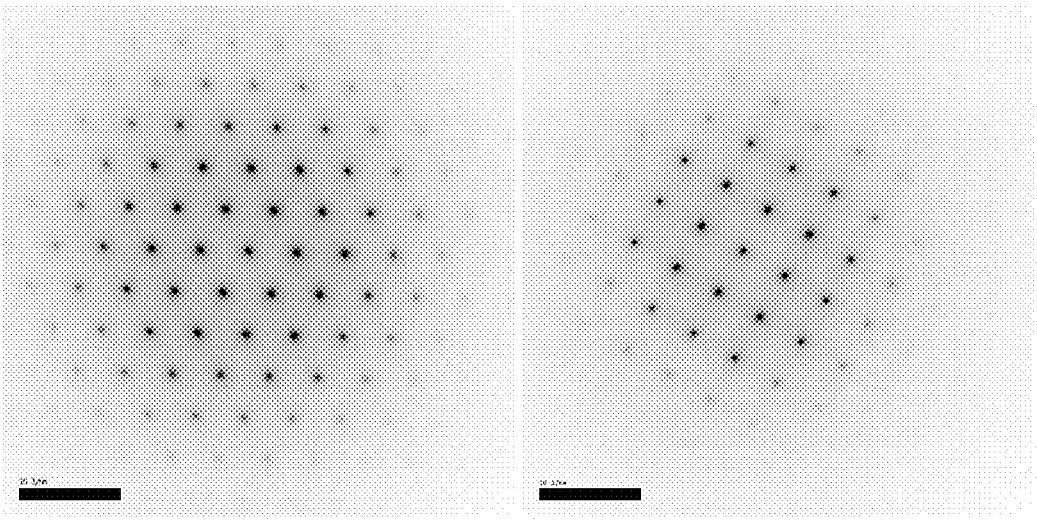
(a) (b)
Figure 4. selected area diffraction TEM patterns of the as-received sheet material confirming the (a) [111] and (b) [100] zone axis of the BCC phase.

TEM images of the material tensile tested at 400C is provided below in Figure 6.
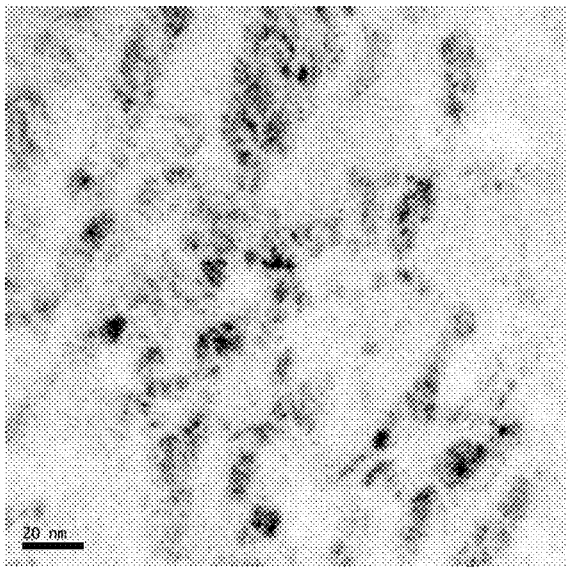
6(a)
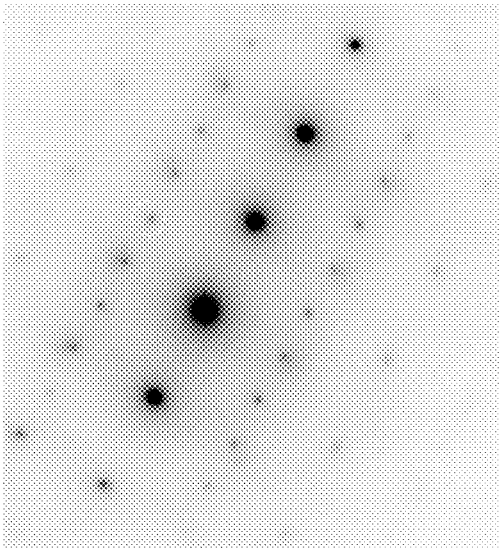
6(b)

Figure 7
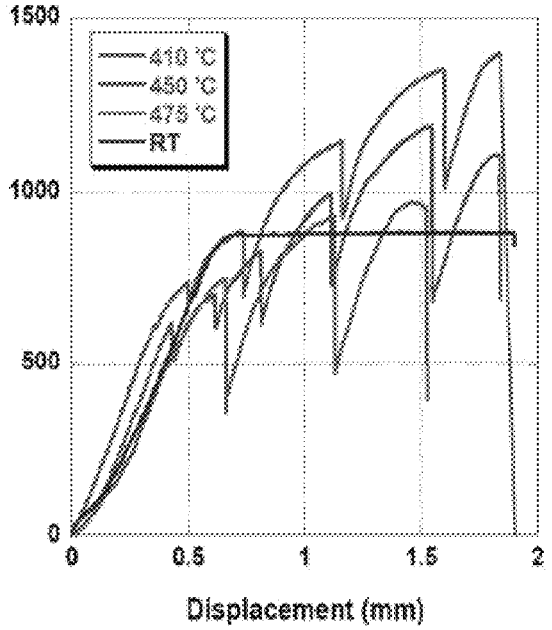
The load increased in several steps
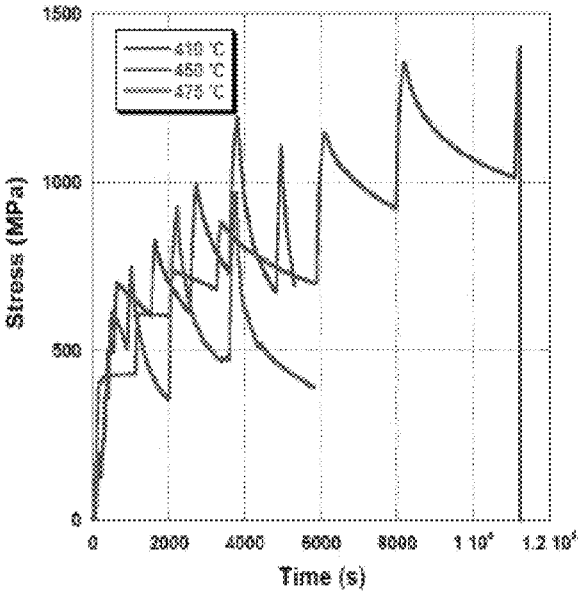
Figure 8a
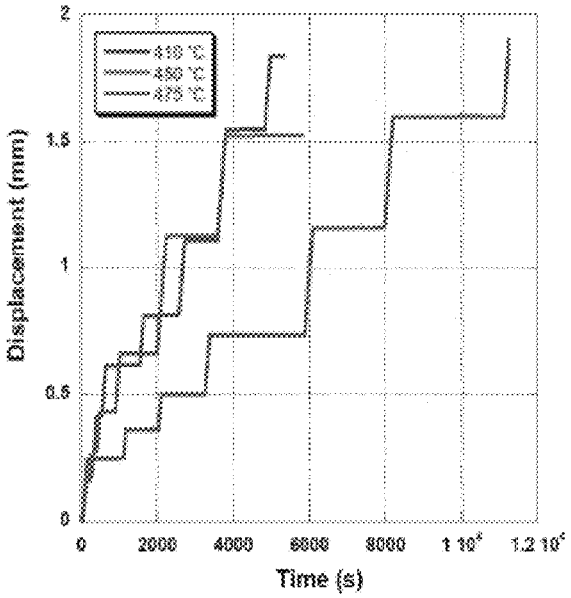
Figure 8b Effect of time on strength at 410 °C Effect of load step size on UTS

Thermomechanical process (TMP)

Effect of TMP on RT UTS

RT tensile properties: Effect of aging at 410 ° C

Dynamic Mechanical Analysis (DMA)

TITANIUM ALLOY AND METHOD OF FORMING A TITANIUM ALLOY

CROSS-REFERENCE TO RELATED APPLICATIONS

This application claims the benefit of U.S. Provisional Application No. 62/279,944, filed on Jan. 18, 2016. The entire disclosure of the above application is incorporated herein by reference.

FIELD

The present disclosure relates to a Ti alloy and a thermomechanical treatment which results in high strength Ti alloys at elevated temperatures.

BACKGROUND AND SUMMARY

This section provides background information related to the present disclosure which is not necessarily prior art. Titanium alloys are being targeted for elevated-temperature structural applications and this alloy exhibits special mechanical properties that may make it attractive for the aerospace and automotive industries for the compressor sections of turbine blades. It may also attractive for nuclear reactor or any nuclear applications where structural parts experience temperatures on the order of 400 C during service.

Nickel-base and cobalt-based superalloys have beneficial properties and are currently being used in the compressor sections of turbine engines and other sections of turbine engines. However their density is approximately 8 grams/cubic centimeter. The density of the titanium alloy of interest is approximately 5 grams/cubic centimeter. Thus a significant reduction in weight is possible if the titanium alloy is used. This will result in energy savings and reduction in fuel use and can ultimately lead to cost savings as well. A more efficient engine could be possible with lighter parts.

Moreover, if high strength can be obtain by the hot rolling process, this teaching will lead to inexpensive process, which may be very attractive to many other industries that looking for low-cost, high strength, and corrosion resistance materials like chemical process, petroleum, biomedical, and also sport goods industries.

This section provides a general summary of the disclosure, and is not a comprehensive disclosure of its full scope or all of its features. This teaching is discovering a thermomechanical process, which results in exceptionally high strength (1400 MPa) and good ductility of a titanium alloy at elevated temperatures (~400 C).

At room temperatures, the materials described herein do not contain omega phase. Through heat treating and strain, omega phase is produced which provided increased material properties such as strength and fatigue resistance. This omega phase is stable at room temperatures provides room temperature properties that are also enhanced by this process. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 represents a stress versus displacement curves for the tensile tested sheet material at different temperatures;

FIG. 2 represents electron backscatter diffraction (EBSD);

FIG. 4 represents a transmission electron microscope (TEM) images confirming that it is only containing the BCC phase;

FIG. 6 represents a Dark field TEM image of the material after tensile testing at 400 C;

FIG. 7 represents a stress and displacement curve testing materials according to the present teachings at various temperatures;

Figure 9:
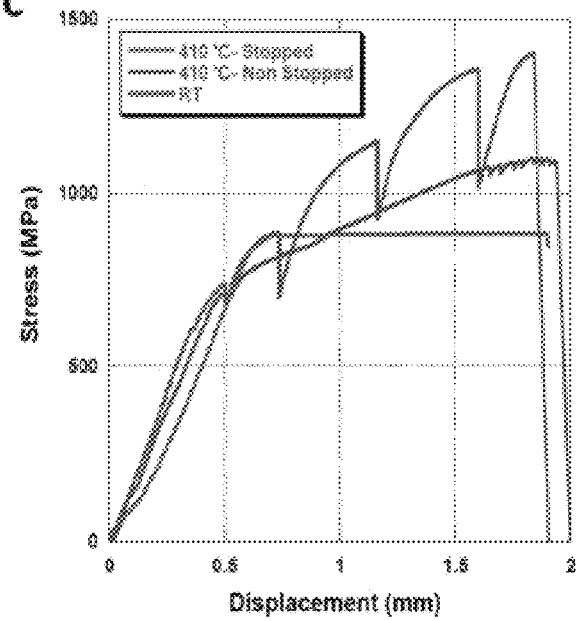
Figure 10:
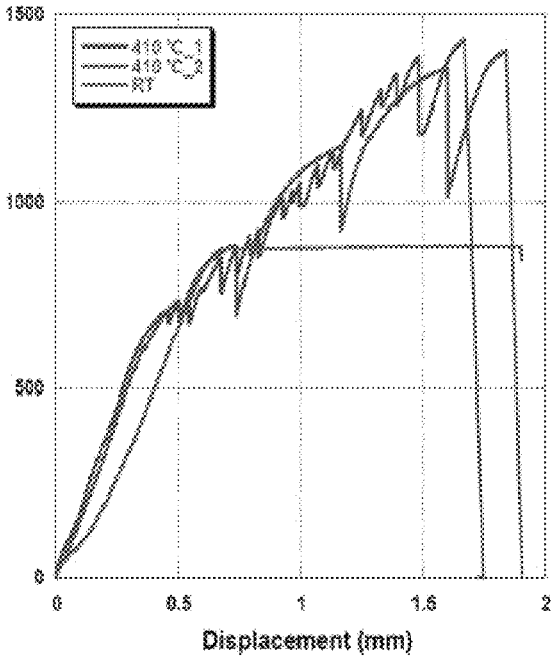
Figure 11A:
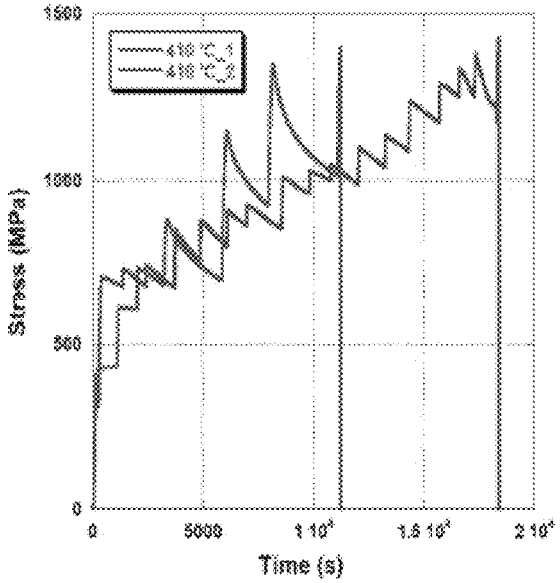
Figure 11B:
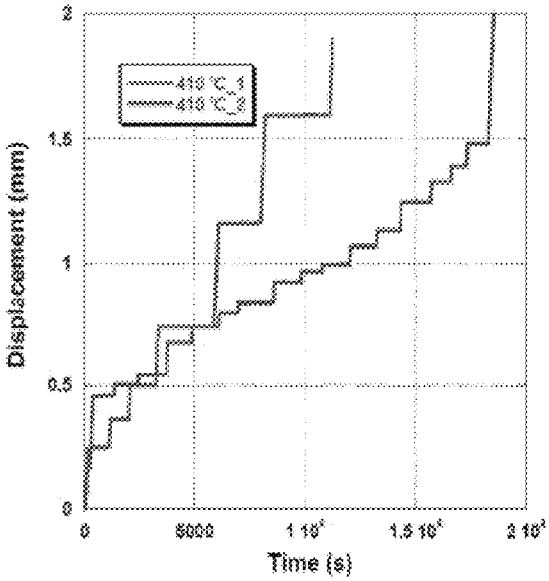
Figure 12:
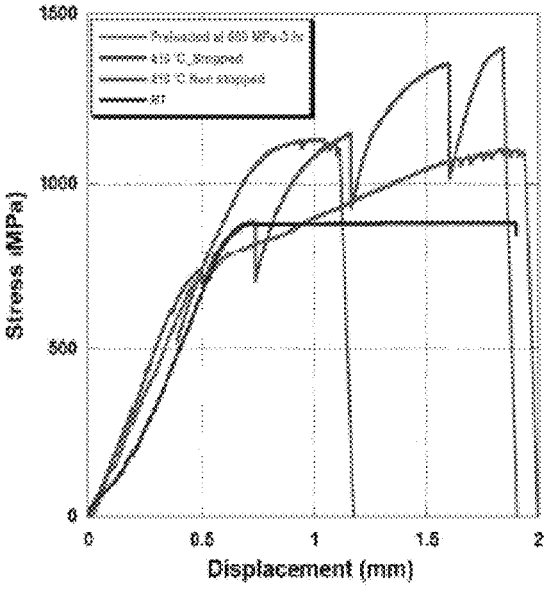
Figure 13:
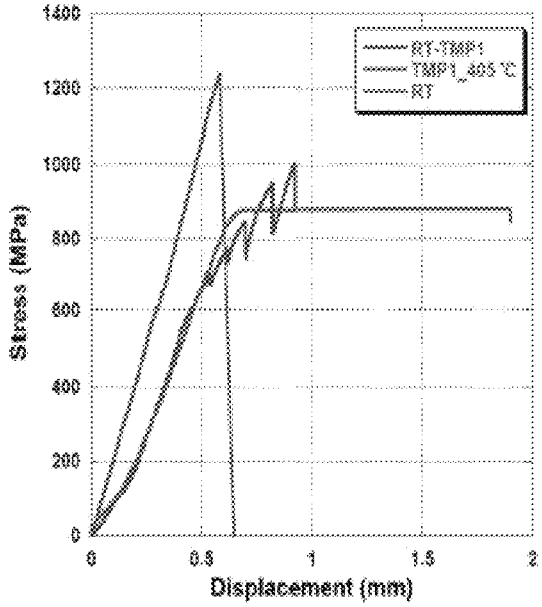
Figure 14:
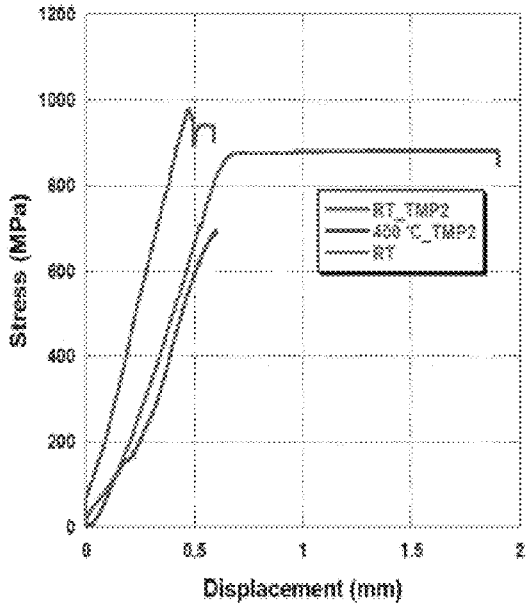
Figure 15:
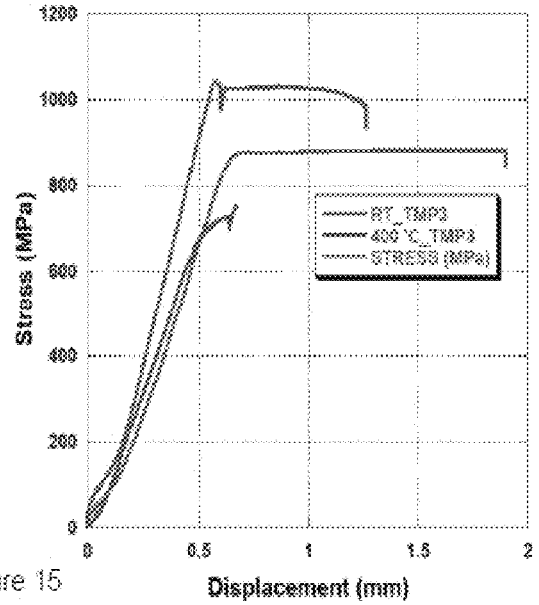
Figure 16:
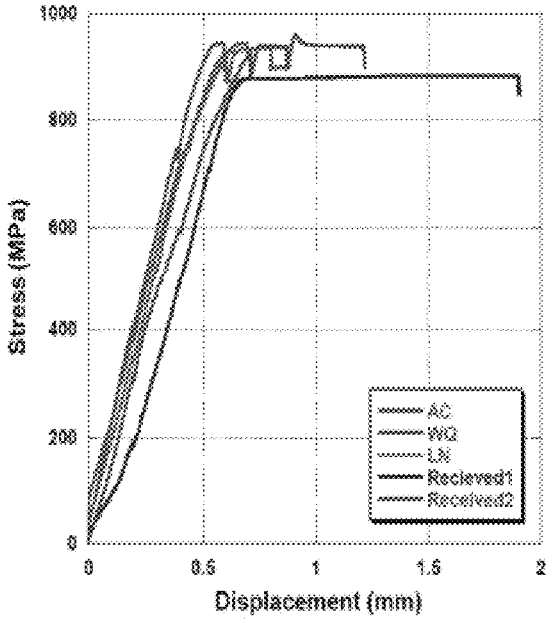
Figure 17:
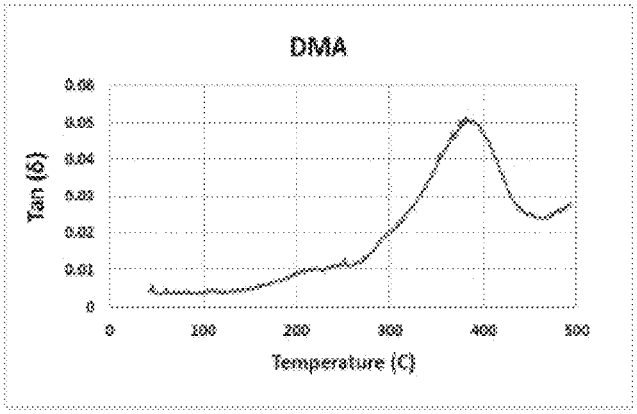
Figure 18:
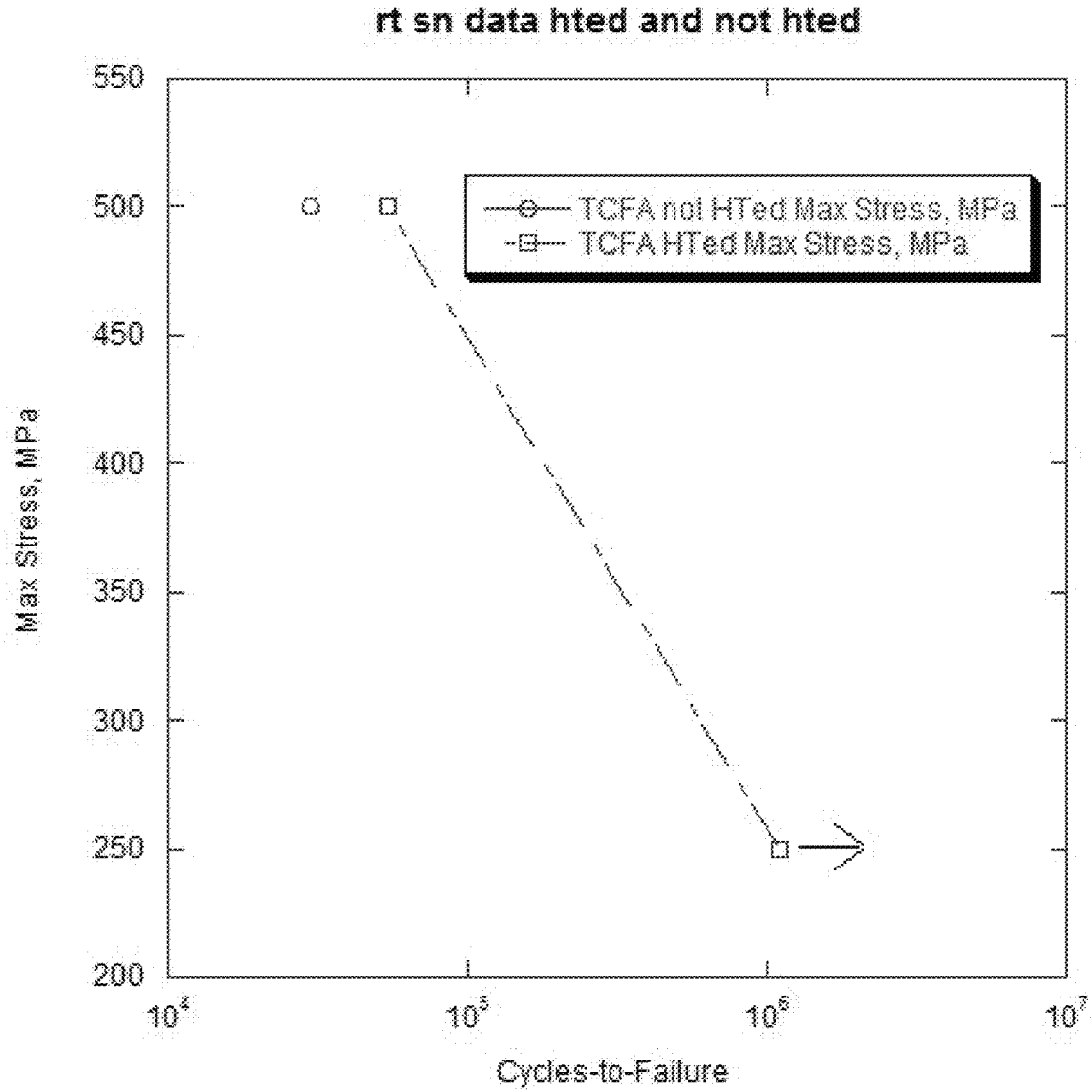

FIGS. 8*a* and 8*b* represent stress and displacement v. time curves testing materials according to the present teachings at various temperatures;

FIG. 9 represents a stress and displacement curve testing materials according to the present teachings at various temperatures;

FIG. 10 represents a stress and displacement curve testing materials according to the present teachings at various temperatures;

FIGS. 11*a* and 11*b* represent stress and displacement v. time curves testing materials according to the present teachings at various temperatures;

FIG. 12 represents a stress and displacement curve for the thermomechanical processing of the material according to the present teachings at various temperatures;

FIGS. 13-16 represent stress and displacement v. time curves testing materials subjected to thermomechanical process according to the present teachings at various temperatures;

FIG. 17 represents a dynamic mechanical analysis of the material according to the present teachings;

FIG. 18 represents the fatigue testing of materials produced using the present teachings.

Corresponding reference numerals indicate corresponding parts throughout the several views of the drawings.

DETAILED DESCRIPTION

Example embodiments will now be described more fully with reference to the accompanying drawings. According to the present teachings, a Ti-11Cr-3Fe-al (wt. %) alloy, which originally contains the body-centered-cubic structure (termed beta phase) is heated to approximately 400 C. At an elevated temperature, it is strained in tension to approximately 2%, where the formation of a hexagonal structure phase (termed omega) occurs through a transformation from the beta phase. This omega phase is stronger than the beta phase. The right combination of the omega phase is only formed when this processes is followed. It is noted that if the omega phase is formed from simply a temperature (without stress or strain), then the exceptional mechanical properties are not obtained. The resulting material is both strong and ductile.

According to the present teachings, the portion of the beta phase that is converted to omega phase is a very fine size scale phase inside the parent matrix (in order of few nanometers). Upon the transformation, the local bonding strength of atoms is increased.

In addition, these very fine particles pin the motion of dislocations. These mechanisms result in higher global strength. By increasing the volume fraction of omega phase, the strength of alloys increases. However, the fractured elongation usually decreases significantly by increasing the omega phase volume fraction, and the fractured surface exhibit a brittle fracture mode. As such, this new process enhances both strength and ductility by increasing the uniformity of distribution of this metastable phase.

It was discovered that the stress can be kept constant for a period of time at ~400 C, and then increased the level of stress, and then kept it constant for another period of time. As shown in FIG. 1, by repeating this process, the maximum strength will be achieved. The transformation can have a saturation point at each level of stress, and the saturation level will increased by the level of stress. By spending enough time at each level of stress, a uniform distribution of transformation will be achieved which results in enhancing both strength and ductility. However, if enough time is not given, more localized transformation will be happened, that results in lower ultimate strength. It is envisioned very small rate of continuous loading can be used to form a material with high strength.

Thermomechanical experiments verify the properties of this alloy at temperatures around 400 C. While the material can be formed at 400 C, it is envisioned the material can be formed at a range of temperatures (250-500) in which this special transformation takes. It should be noted that heating the material to 400 C and then cool the sample to room-temperature, the special mechanical properties are not exhibited. It is further envisioned the cooling rate is important to the material formation. In this regard, the effects of the thermomechanical processing window needed to maintain the transformation to the Omega phase.

Optionally, the material can cool down the sample at several level of stress about 400 C, to effect of the transformation on room temperature mechanical properties. It is believed this will produce a material having higher strength. Important will be the ductility of the transformed material at room temperature. With bot higher strength and good ductility, the process can lead to more application of this teaching in more areas like, biomedical field, chemical pipe industries, and petroleum equipment. Generally in any filed that high strength, good ductility, and corrosion resistance are needed. As this alloy is an inexpensive Ti alloy, it may lead to open an new area of research for more usage of this type of alloy, which only about 5% of total world Ti alloy production is belong to beta type Ti alloys.

The phase transformation occurs in Ti-13Cr-1Fe-3Al alloy. It is believed however that the nature of this work will be applicable for Ti alloys, which show a metastable omega phase at elevated temperatures. Also, this teaching might be attractive to biomedical, chemical and petroleum industries as it is applicable to inexpensive Ti alloy. The alloy composition is: Ti-13Cr-1Fe-3Al which is processed into a rolled sheet of this composition and it is a ductile alloy that is relatively easily rolled into sheet.

The tensile data from the sample tested at 400 C is provided below in FIG. 1. FIG. 1. Represents a stress versus displacement curves for the tensile tested sheet material at different temperatures. The material that exhibited the highest strength was that tested at 410 C. This is unusual as most Ti alloys exhibit the greatest strength at room temperature (RT) and the strengths decrease with increased testing temperature. However, in this case the microstructure changed from a predominately BCC phase to another phase (omega phase) during the stress-temperature environment imposed during the tensile test. The time of the test was also important as the longer that sample was exposed to the temperature-stress combination, the greater strengths were achieved. This is also an indication that the microstructure was changing phase during the experiment. Of note a heat treatment performed on the sheet material at 400 C without subjecting the material to a load. This material was then tested at room temperature. The strength achieved as not higher than the as-received sample tested at room temperature. This suggests that the loading during the heat treatment is necessary to induce this phase transformation.

Figure 3B:
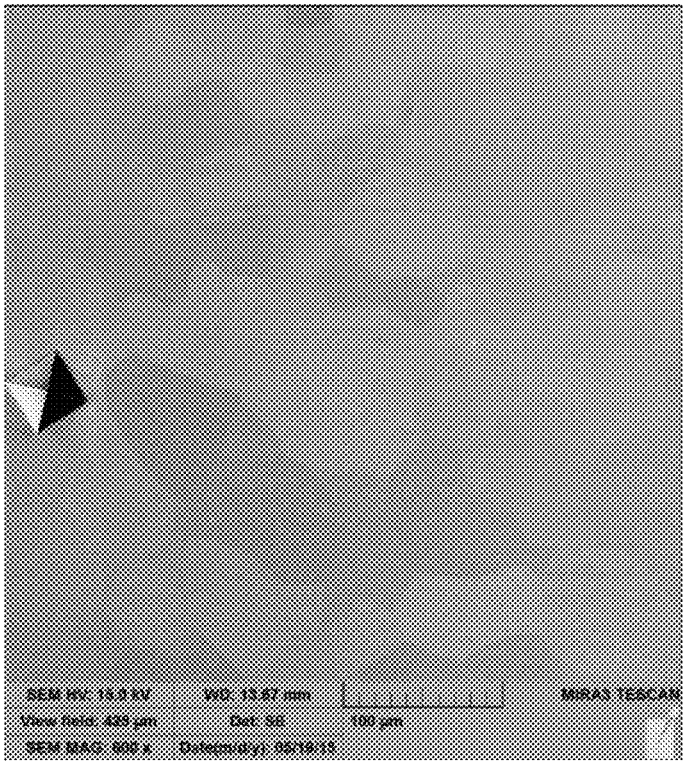
FIG. 3 represents a scanning electron microscope (SEM) of the material.

The room-temperature ultimate tensile strength (UTS) of this material is nothing extraordinary for titanium alloys as the UTS is ~900 MPa. As can be seen, the UTS value at T=400 C is ~1400 MPa (see green curve). Based on the initial literature search this is the strongest Ti alloy at 400 C, this strength was not achieved at that temperature in the literature on Ti alloys. At room temperature, the microstructure consists of the body-centered-cubic (BCC) phase and below is electron backscatter diffraction (EBSD) (see FIG. 2) scanning electron microscope (SEM) (see FIG. 3) and transmission electron microscope (TEM) images (see FIG. 4) confirming that it is only containing the BCC phase. The grain size of the processed material at room temperature is 50 microns.

Figure 5:
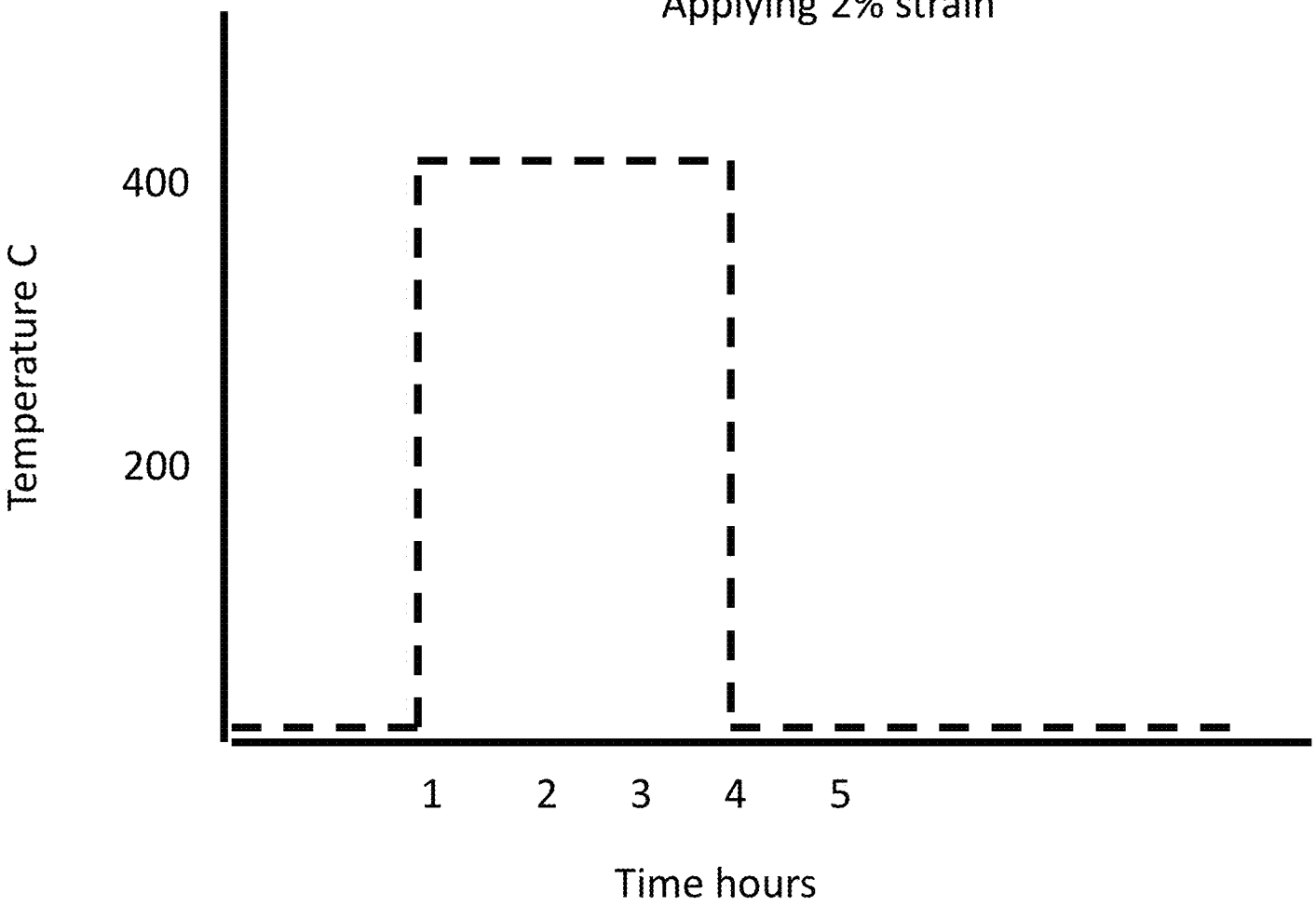
FIG. 5 represents a heat treatment schedule for the material (performed without an external load applied)

The heat treatment schedule for the material (performed without an external load applied) is provided in FIG. 5. It is noted that without the application of load applied to the sample during this heat treatment, the exception tensile strengths were not acquired. The 400 C heat treatment during the applied loading lasted approximately 1-3 hours and this appeared to be sufficient to bring out the phase transformation required for strengthening the material. After the tensile test was complete, the sample was slow cooled back to room temperature. It is noted that the tensile tests were performed in both air and vacuum environments, so the atmospheres varied and this did not seem to affect the phase transformation or strengthening behavior. The rate of cooling would also not be expected to have significantly influenced the phase transformation or strengthening behavior as the key components appear to be the load and the temperature applied simultaneously and once these are supplied the phase transformation is complete.

FIG. 6 represents Dark field TEM image of the material after tensile testing at 400 C. The white areas in this image are representative of the phase in which the diffracted spot in (b) was obtained. Image (b) represents a selected area diffraction pattern where the diffracted spots are taken from two phases; the BCC phase and the phase in which the BCC transformed into during the tensile deformation. It is difficult to know exactly what the fraction of the second phase is in the material from the TEM data, it is estimated however that a fraction of 0.1 of the second phase exists in the material after the 400 C tensile deformation and ~0.9 of the material remains the BCC phase.

FIG. 7 represents a stress and displacement curve testing materials according to the present teachings at various temperatures. FIGS. 8*a* and 8*b* represent stress and displacement v. time curves testing materials according to the present teachings at various temperatures. FIG. 9 represents a stress and displacement curve testing materials according to the present teachings at various temperatures. FIG. 10 represents a stress and displacement curve testing materials according to the present teachings at various temperatures. FIGS. 11*a* and 11*b* represent stress and displacement v. time curves testing materials according to the present teachings at various temperatures. FIG. 12 represents a stress and displacement curve for the thermomechanical processing of the material according to the present teachings at various temperatures. FIGS. 13-16 represent stress and displacement v.

time curves testing materials subjected to thermomechanical process according to the present teachings at various temperatures.

FIG. 17 represents a Dynamic mechanical analysis of the material according to the present teachings. Shown is a peak representing a phase transformation from beta to omega phase.

The Range of Ti alloys can be based on 11-15 wt. % Chromium with the base metal as Titanium (i.e. Ti ranging between 89-85 wt. %). When this material is cast and cooled it is in the body-centered-cubic crystal (BCC) structure (beta phase). It is also in the BCC structure after it is rolled. The BCC structure is ductile and allows for the material to be relatively easily shaped into most any component. However the BCC strength (even in this compositional range) is not very strong. That is, the tensile and compression and creep and fatigue strengths are not remarkable compared to other Ti based alloys. However, when this material is heat treated in the range of 400-475 C, the BCC beta phase will transform into a hexagonal omega phase structure and this will provide significant tensile, compressive and creep strengthening. The material can be deformed in the beta phase then heat treated to change it to the Omega phase. Straining the material while heating it will accelerate the phase transformation from the BCC phase to the omega phase. By adjusting the temperature, timing, and stress, different volume fractions of the omega phase can be induced to alter the strength and the elongation-to-failure (i.e. ductility) of the component. In addition, the omega phase has a greater stiffness than the BCC phase (this is a result of the bond strength in the omega phase being greater than the bond strength of the bcc phase.

FIG. 18 represents fatigue testing for the material compared to normally used TiAl material, as can be seen, at 500 Mpa, the new material vastly out preforms normally used TiAl material. At 250 Mpa, the material disclosed herein is able to withstand over 10^6 cycles at with no failures. creep results we have obtained for this material below showing that the transformed Ti-13Cr-3Al-1Fe(wt. %) alloy has better creep resistance after the transformation and it even has better creep resistance than the most commercially used Ti alloy: Ti-6Al-4V (wt. %).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Optionally, it is envisioned a hot rolling process on a solution treated alloys at a temperature, which results in formation of omega phase, may also increase the strength significantly. It is envisioned the hot-rolling will result in very simple, easy, and inexpensive thermomechanical process which results in producing inexpensive high strength Ti alloy.

Compositional range in which this stress-induced phase transformation takes place. It is envisioned that this composition would not be the only composition in which this stress-induced phase transformation takes place. It is envisioned that changes in the range of Fe, Al, and Cr contents where such an alloy system would exhibit this stress-induced phase transformation. It is envisioned that the range of compositions could be Ti-xCr-yFe-zAl, where 16>x>10, 4>y>0, and 6>z>0. It is also possible that no Fe or Al is required at all for the phenomenon to occur.

The hardness of the sample deformed at 400 C (~400 Hv) was significantly greater than that for the as-received sheet material (~300 Hv). This is consistent with the increase in UTS values. The alloy can include 85-89 wt % Ti, 11-15 wt % Cr, and having 20%-80% omega phase which has been transformed from Beta phase during a heat treatment, or heat treatment and work hardening strain regime. Additionally, the alloy can include at least one of Fe and Al. Specifically, the alloy can include 85-89 wt % Ti, 11-15 wt % Cr, greater than or equal to 0-5 wt % Fe, greater than or equal to 0-5 wt % Al. The balance of the material can be beta phase. Alternatively, the alloy can be Ti-xCr-yFe-zAl, where 16>x>10, 4>y>0, and 6>z>0, and having omega phase and particularly greater than 20% omega phase and beta phase. In this regard, the alloy can include a balance of beta phase.

According to the present teachings, method of producing a titanium alloy includes creating an alloy of 85-89 wt % Ti, 11-15 wt % Cr, 0-5 wt % Fe, 0-5 wt % Al; and subjecting the alloy to heat treating at temperature between 250 and 500 degrees C., thereby converting a portion of the alloy from a beta phase to omega phase. To accelerate the phase transformation, the method can include subjecting the alloy to strain at a temperature between 250 and 500 degrees C. This can include increasing strain over time during heat the step of heat treating. The alloy can optionally be subjected to heat and or heat and strain until it contains omega phase and preferably between 20% and 80% of the alloy is omega phase.

Also, the method can include creating an alloy of Ti-xCr-yFe-zAl, where 16>x>10, 4>y>0, and 6>z>0; and subjecting the alloy to strain at a temperature between 250 and 500 degrees C., thereby converting a portion of the alloy from a first phase to a second phase. The alloy can be subjected to hard working (e.g. tensile strain) at a temperature between 250 and 500 degrees C. to accelerate the transformation of a portion of the alloy from a first phase to a second phase over a shorter time. Alternatively, the alloy can be subjected to strain at a temperature between 400 and 500 degrees C. to accelerate the transformation of a portion of the alloy from a first phase to a second phase. Optionally, the alloy produced can be Ti-11Cr-3Fe-1Al which is subjected to incremental strain over time.

The headings (such as "Introduction" and "Summary") and sub-headings used herein are intended only for general organization of topics within the present disclosure, and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition or method.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

As used herein, the word "desired" refers to embodiments of the technology that afford certain benefits, under certain circumstances. However, other embodiments may also be desirable, under the same or other circumstances. Furthermore, the recitation of one or more desired embodiments does not imply that other embodiments are not useful, and is not intended to exclude other embodiments from the scope of the technology.

As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components or process steps, the present technology also specifically includes embodiments consisting of, or consisting essentially of, such materials, components or processes excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An alloy comprising:

85-89 wt. % Ti, 11-15 wt. % Cr, and having an omega phase, wherein the alloy is generated by simultaneously subjecting an alloy composition comprising the Ti and the Cr and beta phase to a heat treatment and to a strain, which causes a portion of the beta phase to transform to the omega phase.

2. The alloy according to claim 1, further comprising at least one of Fe and Al.

3. The alloy according to claim 2, comprising 85-89 wt. % Ti, 11-15 wt. % Cr, 0-5 wt. % Fe, and 0-5 wt. % Al, and comprising 20%-80% of the omega phase.

4. The alloy according to claim 2, wherein the alloy comprises 85 wt. % Ti, 13 wt. % Cr, 1 wt. % Fe, and 3 wt. % Al.

5. The alloy according to claim 1, further comprising a beta phase.

6. A method of producing a titanium alloy, the method comprising:

creating an alloy of 85-89 wt. % Ti, 11-15 wt. % Cr, 0-5 wt. % Fe, and 0-5 wt. % Al;

subjecting the alloy to a heat treatment by heating the alloy at a temperature between 250 and 500° C.;

during the heat treatment, subjecting the alloy to a strain; and converting a portion of the alloy from a beta phase to an omega phase during the heat treatment to form the titanium alloy.

7. The method according to claim 6, further comprising:

subjecting the alloy to increasing strain over time during the heat treatment.

8. The method according to claim 6, further comprising:

subjecting the alloy to strain during the heat treatment until between 20% and 80% of the alloy is the omega phase.

9. An alloy comprising:

Ti-xCr-yFe-zAl, where $10<x<16$, $0\leq y<4$, and $0\leq z<6$, and having greater than 20% an omega phase.

10. The alloy according to claim 9, wherein the alloy further comprises a beta phase.

11. The alloy according to claim 9, wherein the alloy further comprises a balance of the beta phase.

12. A method of producing a titanium alloy, the method comprising:

creating an alloy of Ti-xCr-yFe-zAl, where $10<x<16$, $0\leq y<4$, and $0\leq z<6$; and subjecting the alloy to strain at a temperature between 250 and 500° C., thereby transforming greater than 20% of the alloy from a beta phase to an omega phase and forming the titanium alloy.

13. The method according to claim 12, wherein the subjecting the alloy to strain at the temperature between 250 and 500° C. accelerates the transformation of the portion of the alloy from the beta phase to the omega phase.

14. The method according to claim 12, wherein the subjecting the alloy to strain is performed over time.

15. The method according to claim 12, comprising subjecting the alloy to strain at a temperature between 400 and 500° C. to accelerate the transformation of the portion of the alloy from the beta phase to the omega phase.

16. The method according to claim 12, wherein the creating the alloy of Ti-xCr-yFe-zAl comprises creating an alloy of Ti-11Cr-3Fe-1Al.

17. The method according to claim 16, wherein the subjecting the alloy to strain comprises subjecting the alloy to incremental strain over time.

18. The method according to claim 12, wherein the subjecting the alloy to strain comprises subjecting the alloy to incremental strain over time.

19. The method according to claim 12, wherein the subjecting the alloy to strain comprises straining the alloy in tension to approximately 2%.

* * * * *